US006113101A

United States Patent [19]

Wirth

[11] Patent Number: 6,113,101

[45] **Date of Patent: *Sep. 5, 2000**

[54] METHOD AND APPARATUS FOR PLAYING CASINO POKER GAME

[76] Inventor: John E. Wirth, 10808 Depot - P.O. Box 400, Worth, Ill. 60482

[ * ] Notice: This patent is subject to a terminal disclaimer.

[21] Appl. No.: 09/193,169

[22] Filed: Nov. 16, 1998

Related U.S. Application Data

[63] Continuation-in-part of application No. 08/788,909, Jan. 23, 1997, Pat. No. 5,845,906, which is a continuation-in-part of application No. 08/556,067, Nov. 9, 1995, abandoned.

[51] Int. Cl.[7] ..... A63F 1/00

[52] U.S. Cl. ..... 273/274; 273/292

[58] Field of Search ..... 273/274, 292

[56] References Cited

U.S. PATENT DOCUMENTS 5,042,818 8/1991 Weingardt .
5,320,356 6/1994 Cauda ..... 273/274
5,431,408 7/1995 Adams ..... 273/292
5,544,832 8/1996 Breeding ..... 273/274
5,626,341 5/1997 Jones et al. ..... 273/274

*Primary Examiner*—William M. Pierce
*Attorney, Agent, or Firm*—Marshall, O'Toole, Gerstein, Murray & Borun

[57] ABSTRACT

A casino game, based on the rules of poker, wherein each player is dealt five cards, with an option to utilize a sixth card to improve the five-card hand. The game provides a player with three opportunities to win: 1) head-to-head competition against the dealer, with the higher poker hand winning; 2) competition for a common pot among the players, the amount of the pot increasing until a player has a hand of three-of-a-kind or better; and 3) bonus payments for long-odds hands (e.g., straight or better). Because no player has an opportunity to increase his/her wager during play, the game proceeds rapidly.

3 Claims, 2 Drawing Sheets

METHOD AND APPARATUS FOR PLAYING CASINO POKER GAME

CROSS-REFERENCE TO RELATED APPLICATION

This application is a continuation-in-part of application Ser. No. 08/788,909, filed Jan. 23, 1997, now U.S. Pat. No. 5,845,906, which was a continuation-in-part of application Ser. No. 08/556,067, filed Nov. 9, 1995, now abandoned.

BACKGROUND OF THE INVENTION

The present invention relates generally to a playing card wagering game which is based, in substantial part, on the rules of poker. The game is particularly applicable to a casino environment in which multiple players compete with themselves and with the house, but can also be played in a home environment.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al). Somewhat similarly, U.S. Pat. No. 3,667,757 (to Holmberg) discloses a board game and apparatus, including a way to allow the player to make a choice with respect to several different alternative types of game play and risk-bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,437,462 (to Breeding) discloses a casino-type poker game wherein players are given an opportunity to withdraw at least a part of their bets before all the cards are dealt. The game employs at least one common card which can be used by all of the players.

SUMMARY OF THE INVENTION

The present invention relates to a card game, in particular to a card game suitable for use in casinos, and to tables for playing the game. The game combines the concepts of draw poker with simultaneous play against a dealer (house) and play against other players. Players who are dealt premium hands receive bonus payments, depending on the value of the hand. Because the players are not permitted to increase their wagers, the game moves rapidly.

The game follows the rules of stud poker. Each player's poker hand is made from 5 dealt cards and an optional card if a player elects to pay the house for an additional card. The dealer has same option as other players, i.e., to make the best five-card hand from six cards; however, the dealer does not pay for an additional card. Each player plays head-to-head against the dealer for one part of the wager, and against the other players or another part of the wager (the "common" or "best hand" pot). A bonus or premium pot provides the players with a third opportunity to win.

Premium or bonus pots have become very popular with the gaming public. This game incorporates a premium pot, but unlike conventional games (e.g., Caribbean Stud) where players contribute to the makeup of that pot, the present game has a bonus system which does not require a direct contribution by the players. In the present game, it is envisioned that a player having an extraordinary poker hand (e.g., a straight or higher) will receive a bonus or premium payment from the house, based on the statistical rarity of the hand. Funds to pay the bonus can be generated from the monies paid to the dealer (house) in the course of the game when players buy a card from the dealer. Although the amount or cost of the one card can be determined by the house, the suggested price in this game would be $2.00. Because premium payouts will not be an every-game occurrence, sufficient funds to seed and maintain this bonus pool can easily be obtained from amounts paid for extra cards over the course of many hands. Similarly, the funds required to seed the game as a tournament game can be obtained from amounts paid for extra cards.

The game would proceed as follows. The dealer (house) operates from a table playing station which provides easy access to the players. In addition to the dealer, the game can be played by as many as six players around the table, each operating from a playing station which has a card playing area and a betting area. Each player's betting area contains at least two wager zones: a first ante zone, and a second zone for purchasing a sixth card from the dealer. The players' stations also contain regions or areas where cards can be dealt.

In a preferred method, play would commence as follows: Each player would place a predetermined amount in first ANTE zone at his/her station on the table as well as a predetermined amount to cover the purchase of an additional card in a second CARD zone. The suggested amounts for ante for this game would be $5.00 per hand in the ANTE zone, and $2.00 in the second CARD zone to cover the purchase of an additional card. These amounts are given for purposes of illustration only, and could be higher or lower at house discretion.

Six cards are dealt to each player, all at one time, starting from the dealers left to right; one of the six cards is placed in a separate area in front of the player, for example, under the wager in the CARD zone. In a preferred method, a marker, such as a plastic button, is moved from player to player after each hand from dealer's left to right so that a different player is first each hand. The dealer also receives six cards at one time which are placed in a designated area for the dealer. Players and dealer's cards are dealt face down. The playing table also contains a region for bets between the players. This can either be a third zone at each player's station or, preferably, a designated region of the table between the players and the dealer. These third wagers comprise a common pot which can only be won by a player; the dealer is not eligible.

However, although the dealer does not participate as a player, the house is entitled to a portion of this pot as a service charge or "rake". A commonly-used rake for casino card parlors is 5% of the pot, to a maximum of $5.00 per hand. The house "rake" in this case could be much smaller. A schedule of amounts to be "raked" could be: $1.00 for each $30.00 accumulated in "players pot"; (i.e., a 3.3% rake).

This "rake" would be paid to the house when "players pot" is finely won by a player. If "players pot" is under $25.00, no "rake" would be taken.

The players look at their five cards and determine if they are going to play. If a player is going to fold, he or she indicates this by discarding all five cards to the dealer. Dealer then picks up the ante wager in the player's first betting zone and the sixth card; the two dollar sixth card wager in the second betting zone would be pushed back to the folding player. If a player opts to continue, he or she indicates this by placing a third wager (e.g., five dollars) in the area of the table for bets among the players, i.e., the common pot. (This area or zone could be labeled, "Best Hand Bonus"). Finally, the dealer would pick up the extra card payments from each of the players unless the player opts to "stand pat". In the latter event, the dealer would remove the sixth card and return the two dollar payment in the second betting zone to the player standing pat. Players who opt to use the sixth card must discard prior to inspecting this card.

All cards returned to the dealer are placed in a discard area on the table. A preferred method would involve placing the discards in a holding area provided on the table, adjacent the dealer's playing station. As noted above, it is envisioned that the receipts from extra-card payments will off-set any payments the house may make to players who have poker hands of a certain value (e.g., a straight or above). Players having these types of hands (a "bonus" hand) are entitled to a bonus or premium in addition to any wagers they may recover from the dealer or from other players through the "best hand pot".

When the dealer has finished with all players, he or she would inspect the six dealt cards and may stand pat or may utilize his or her extra card in an effort to better the hand. (Unlike the players, the dealer is not required to discard prior to inspecting his sixth card). All dealer hands play. After the dealer's best five card hand has been exposed, the dealer calls "cards", and all cards are turned up by the players. This will conserve time and help the game move more quickly.

The dealer pays an amount equal to the ANTE wager in the first betting zone to each player who has a higher poker hand than the dealer, and collects the ANTE bets from all of the players with lower hands than the dealer. Any hands where a player or the dealer have hands of the same value become a "push", and no money is exchanged between a player and the dealer. At the same time, the dealer pays a bonus or premium to any hands that are bonus hands (straight or higher).

For example, payouts by the dealer for hands of straight or better could be based on the amount a player pays for an extra card. Suggested payouts based on this system are as follows:

| | |
|---|---|
| Straight | 3 to 1 |
| Flush | 5 to 1 |
| Full House | 7 to 1 |
| Four of a Kind | 15 to 1 |
| Straight Flush | 25 to 1 |
| Royal Flush | 50 to 1 |

The foregoing payouts could be varied at the discretion of the house.

Finally, any player who has not folded will have anteed money into the common, "Best Hand Bonus" pot. This pot will be paid to player who has the highest poker hand, provided that the hand must be three-of-a-kind or better. If no player has three-of-a-kind or better, the pool continues to the next hand until someone obtains a hand of this type. The dealer does not participate in the Best Hand Bonus pot (apart from the house "rake"). Once a bonus pool has started, no other players may participate at the table until the Best Hand Bonus pool (common pot) has been won by one of the original players.

Thus, a player has three opportunities to win: 1) by having a higher poker hand in one-on-one play with the dealer; 2) by having the highest poker hand, three-of-a-kind or better, among all of the players at the table; and, 3) by having a "premium" hand (e.g., a straight or better) which entitles the player to a premium payout from the house. Operation of the game can be further understood with reference to the description of apparatus for playing the game.

In an alternative embodiment, the game can be played with fewer cards dealt. In this embodiment, a player antes $5.00, plus $2.00 for an extra card and is dealt five cards, face down. The dealer also receives five cards, face down. A hole card is dealt, face down, in an area near the dealer's station labeled, for example, "Sixth Card." After examining his or her cards, each player has the option of staying or folding. If the player folds, the ante is forfeited to the house, but the payment for an extra card is returned to the player. If the player stays, he indicates this intent by placing a wager (e.g., $5.00) in a designated, common-pot area of the table marked, for example, "Best Hand Bonus."

After collecting the extra card payment from each player who has stayed, the dealer turns up his five cards. At the same time, the hole card adjacent the dealer is turned up. This card functions as a community card, and can be used by the dealer and any of the players to form a better five-card poker hand. Other than the fact that a single sixth card is used, the game remains the same. Dealer pays players having better hands, and collects from those having lower-value hands. Any player (other than the dealer) having three-of-a-kind or better is eligible for the best hand bonus, providing his or her hand is the highest in the round. Amounts in the best hand bonus pot are rolled over from hand-to-hand until a player obtains three-of-a-kind or better. Finally, premium payments are made on any hands having a straight or higher.

DETAILED DESCRIPTION OF A PREFERRED EMBODIMENT

Figure 1:
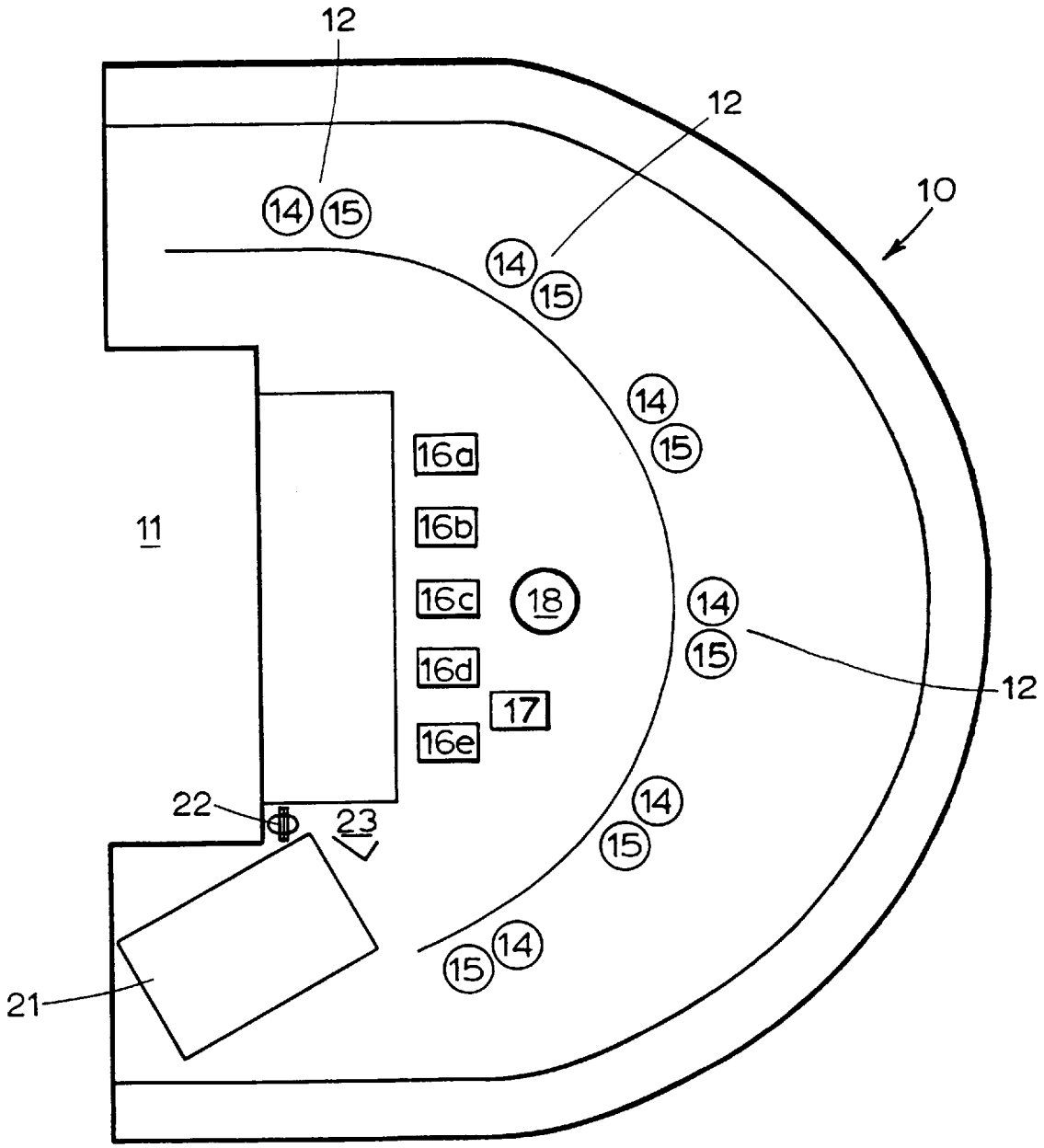
FIG. 1 is a plan view depicting a table which can be used for playing the casino poker game of the present invention.

Referring now to the drawing, FIG. 1 discloses a casino poker table located generally at 10. Table 10 has a generally semi-circular shape and is provided with a dealer playing station 11 and has a plurality of player areas or playing stations 12 surrounding the opposite side of table 10, across from dealer station 11. Each player's station 12 has a player card playing area 13 and a pair of betting zones 14, 15.

In front of dealer's playing station 11 is a card area 16*a*, 16*b*, 16*c*, 16*d*, 16*e* for display of dealer's initial five cards, and a separate card area 17 for display of a sixth card. Adjacent the dealer is a card shuffler 21, a slot 22 for the deposit of chips or money, and a holding area 23 for discards.

As described in the preceding paragraphs, play commences by each player placing an ante wager in first betting zone 14, and an amount in second betting zone 15 to cover the cost of a sixth card. In one embodiment of the invention, the dealer then deals six cards to each of the players, placing five of the dealt cards in each player's card playing area 13, and a sixth card in a separate location, such as under the wager in betting zone 15. Cards are dealt from dealer's left to right, six at a time. All cards, including those in dealer's area 16*a*, 16*b*, 16*c*, 16*d*, 16*e* and 17 are dealt in a face-down position. After inspection of their cards, players who decide to continue signify this fact by placing a third wager in a common pot zone 18. Any player desiring to improve his or her original hand may discard one card and utilize the sixth card at zone 15; the dealer collects the bet at this zone. The cards of players who opt not to continue are removed from play by the dealer; the dealer collects the wager at zone 14 and returns the wager at zone 15 to the folding player.

Once each player has opted to stay or to fold, and has made a decision as to standing pat or using a sixth car at zone 15, play commences by the dealer turning the five cards in areas 16*a*–16*e* to a face-up position. The dealer also has the option of using the sixth card in area 17.

The dealer's hand is compared with the hands of each of the players, in turn. If a player has a higher-value poker hand than the dealer, the wager at zone 14 will be returned to the player, together with an equal amount from the dealer. If the player has a premium hand (as defined above), he or she will receive a bonus payment from the dealer. On the other hand, if a player's hand is lower in value than that of the dealer, the wager at zone 14 will be surrendered to the dealer.

Finally, if one of the player's has a poker hand of three-of-a-kind or better, his or her hand will be compared with the hands of the other players and the funds in common pot zone 18 (less the house rake) will be awarded to the player having the highest value hand. If no player has a hand of three-of-a-kind or better, the wagers in common pot zone 18 will remain and form part of the pot in the next hand.

Figure 2:
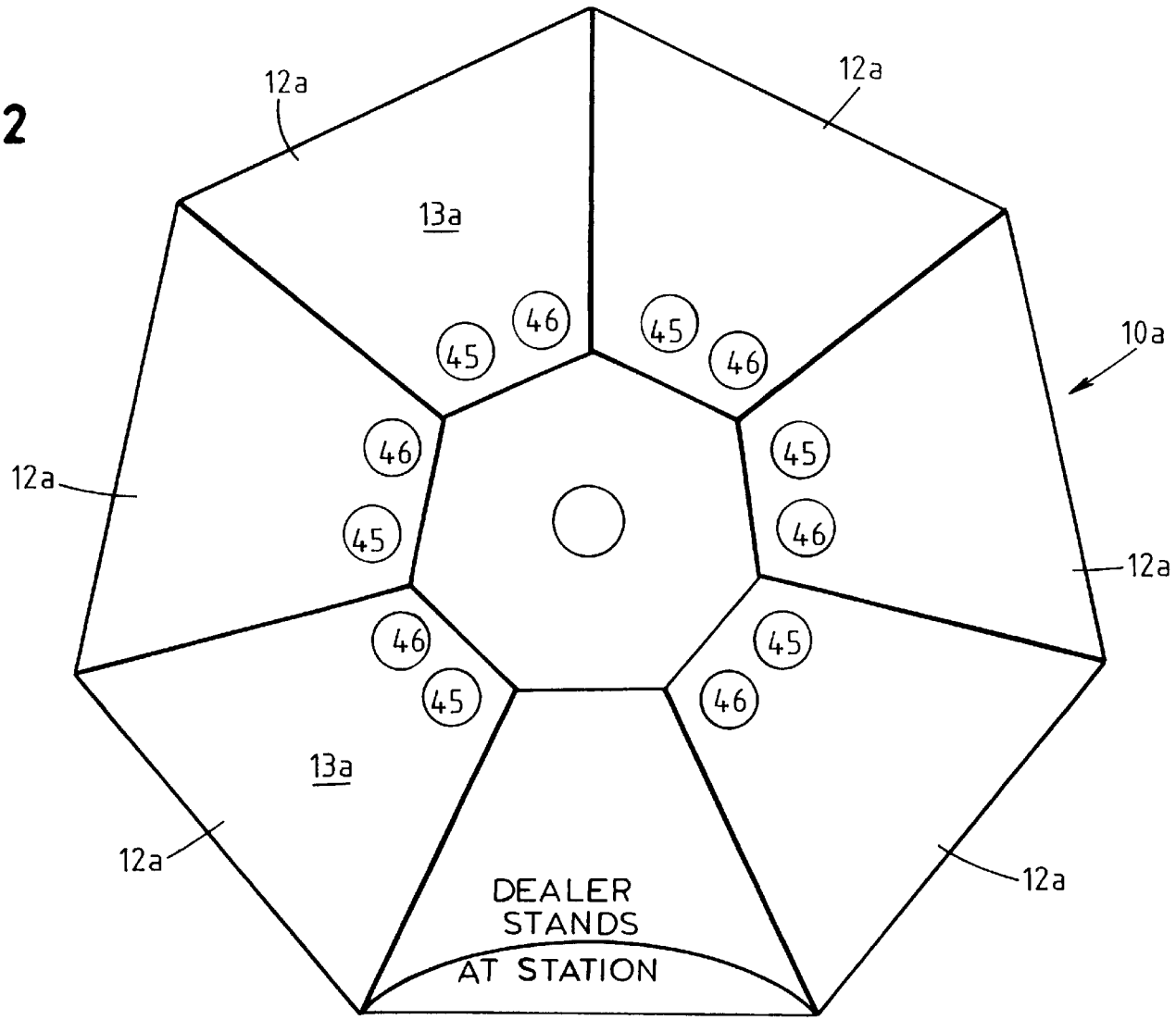
FIG. 2 is a plan view of an alternative table design which may afford more privacy to the players.

FIG. 2 depicts a casino poker table 10*a* having a dealer station and a plurality of player stations 12*a* on each side of the dealer station. Table 10*a* is a variation on the table depicted in FIG. 1 which may offer more privacy to the player.

Each player station 12*a* has a playing area 13*a*, as well as a marked area 45 for placement of a sixth card, and a marked area 46 for placement of a chip if the player desires to use the extra card.

Although a preferred embodiment has been described in detail, it should be understood that various changes and alterations can be made without departing from the spirit and scope of the invention.

What is claimed is:

1. A method of playing a modified draw poker game comprising:

providing a table having a playing station for a dealer and playing stations for a plurality of players, each player station comprising a card playing area;

betting areas on said table having first and second betting zones for each player;

each player placing predetermined wagers in both of said betting zones;

the dealer dealing an initial, five-card hand, face down, to himself and to each player;

providing an opportunity for each player to fold or stay, each player who folds forfeiting the wager in said first betting zone to dealer, and each player who stays placing a third wager in one or more designated locations on the table, said third wagers, less a house rake, comprising a common pot;

providing an opportunity for the dealer and each player to utilize a sixth card to improve a poker hand, a player who opts to utilize a sixth card discarding one card prior to inspecting said sixth card, the dealer collecting the wager in said second betting zone from each player who employs this option;

turning all cards to a face up position:

(a) the dealer paying an amount equal to the wager in said first betting zone to each player who has a higher poker hand than dealer, and collecting the wagers in said first betting zone from each player having a lower poker hand than dealer;

(b) if one or more players has a poker hand whose value is three-of-a-kind or better, the dealer paying the amount in said common pot, less said house rake, to the player having the highest poker hand;

(c) if no player has a poker hand whose value is three-of-a-kind or better, the wagers comprising said common pot are retained and form part of the common pot in the succeeding hand; and (d) the dealer paying a premium to each player whose hand comprises a straight or better.

2. The method of claim 1 further including the step of dealing a sixth card, face down, to each player, said sixth card being placed by the dealer in a location apart from said initial, five-card hand.

3. The method of claim 1 wherein said house rake comprises 3.3 percent of said common pot.

* * * * *